United States Patent [19]

Lim

[11] Patent Number: 4,746,840

[45] Date of Patent: May 24, 1988

[54] FLUORESCENT REFLECTOR LAMP ASSEMBLY

[76] Inventor: Kenneth S. Lim, 47 St. James Pl., Piedmont, Calif. 94611

[21] Appl. No.: 35,016

[22] Filed: Apr. 6, 1987

[51] Int. Cl.[4] ..... H01J 7/44

[52] U.S. Cl. ..... 315/58; 315/57; 315/56; 315/71; 313/313; 313/318; 336/90

[58] Field of Search ..... 313/318, 113; 315/71, 315/57, 56, 58, 326; 362/437; 339/176 L; 336/90

[56] References Cited

U.S. PATENT DOCUMENTS

| | | | |
|---|---|---|---|
| 3,381,575 | 5/1968 | Levin | 313/318 |
| 3,746,906 | 7/1973 | Cardwell | 313/318 |
| 3,987,326 | 10/1976 | Lindae | 313/318 |
| 4,339,685 | 7/1982 | Saguchi et al. | 313/318 |
| 4,363,994 | 12/1982 | Cortorillo et al. | 313/318 |
| 4,470,104 | 9/1984 | Cox | 313/318 |
| 4,479,072 | 10/1984 | Gaugel et al. | 313/318 |
| 4,495,443 | 1/1985 | Cummings | 313/318 |
| 4,538,090 | 8/1985 | Wilhelm et al. | 313/318 |
| 4,623,823 | 11/1986 | Engel | 313/318 |

FOREIGN PATENT DOCUMENTS

| | | | |
|---|---|---|---|
| 919993 | 2/1963 | United Kingdom | 313/113 |

OTHER PUBLICATIONS

Brochure: "The Choice is Yours . . . Eastrock Technology, Inc.".

*Primary Examiner*—David K. Moore
*Assistant Examiner*—Michael Razavi
*Attorney, Agent, or Firm*—Burns, Doane, Swecker & Mathis

[57] ABSTRACT

A fluorescent reflector lamp assembly for use in screw-type sockets for conventional incandescent bulbs includes an Edison-type base connector, a generally annular ballast housing, a reflective shell formed of a heat-conducting material and having a tubular base adapted to seat within a central recess encompassed by the ballast housing, and a receiving member mounted in the recess to receive a fluorescent lamp whose base abuttingly engages a substantial area of the sidewall of the reflector base.

25 Claims, 2 Drawing Sheets

FLUORESCENT REFLECTOR LAMP ASSEMBLY

TECHNICAL FIELD

The present invention generally relates to fluorescent lamps and, more particularly, to fluorescent lamp assemblies that may be conveniently mounted in conventional sockets in substitution for incandescent reflector bulbs.

BACKGROUND OF THE INVENTION

It is well known that fluorescent lamps consume substantially less electrical power than conventional incandescent lighting while producing equivalent illumination levels as measured in lumens. For example, some conventional fluorescent lamps may produce illumination equivalent to a 60-watt incandescent bulb on just 15 watts of power. Further, it is known that fluorescent lamps can often provide substantially longer service lives, sometimes in excess of nine thousand hours, than incandescent bulbs. Because of such advantages of fluorescent lighting, substantial efforts have been made to provide fluorescent lamp assemblies that can be substituted for incandescent bulbs in standard lighting fixtures.

Pursuant to such efforts, fluorescent lamps have been formed in various shapes and have been fitted with base connectors that are compatible with sockets for standard incandescent bulbs. Examples of such fluorescent lamps include ones that are sold under the trademarks "Refluor" and "Reflect-A-Star PL" by Lumatech Corporation of Oakland, California; those fixtures employ so-called PL fluorescent lamps that have U-shaped tubes with starters built into their bases. In some models of such lamps, replaceable starters are also provided. Further it is known in such lamps to provide external plug-in ballasts. Although these lamps usually produce satisfactory lighting levels, the arrangement of their components and their length prevents them from being completely satisfactory for lighting applications such as recessed lighting.

It is also known to fit fluorescent tubes and built-in starters into bulb-shaped housings. Such lamps are available from Mitsubishi Corporation under part number BFT 17 LE. In such lamps, the ballast components (i.e., reactance ballasts) are located in ballast compartments located at the base of the bulb compartments.

Adapters that permit fluorescent lamps to be used in sockets in substitution for incandescent bulbs are available from several sources and are described, for example, in U.S. Pat. Nos. 4,570,105 and 4,623,823. The adapters disclosed in those patents include hollow cylindrical housings, Edison-type bases, and covers enclosing the ends of the housings opposite the bases. Further according to the patents, toroidal ballasts are located within the housings to receive the stems of fluorescent lamps to enhance spacial efficiency. Other adapters and components for fluorescent lamps are available from Eastrock Technology, Inc. of Staten Island, N.Y.

Various other configurations of fluorescent lamps compatible with sockets with incandescent bulbs are suggested by the following U.S. Pat. Nos: 2,505,993; 3,551,736; 3,611,009; 3,815,080; 3,953,761; 4,093,893; 4,173,730; 4,270,071; 4,347,460; 4,375,607; 4,405,877 and 4,414,489.

One serious disadvantage of known designs of such fluorescent lamps, however, is that their ballast components often preclude the lamps from being completely satisfactorily employed in recessed lighting applications. (A recessed lighting application can be defined, for present purposes, as one in which an illuminating lamp, with or without a reflector, is mounted within a canister-like container having an open end through which the lamp shines.) Moreover, although some known fluorescent lamps may have appropriately compact dimensions for use in recessed lighting applications, actual usage of compact flourescent lamps is problematical because the service lives of the lamps fall far short of expectations. In other words, fluorescent lamps in recessed lighting applications have demonstrated a tendency to fail over periods far shorter than their rated lives.

Failures of fluorescent lamps in recessed lighting applications are believed to be caused by high temperatures, sometimes exceeding 225 ° F., which may be generated at the base of the stem of the lamp. Such temperatures can substantially exceed the maximum temperatures recommended by manufacturers, usually about 185 ° F., and may cause early deterioration and failure of the lamp starter and ballast components. For example, the adapter assemblies disclosed in U.S. Pat. Nos. 4,570,105 and 4,623,823 are not well adapted for use in recessed lighting applications because the stems of fluorescent lamps encompassed by the toroidal ballasts would often reach temperatures that would severely limit their service lives.

SUMMARY OF THE DISCLOSURE OF THE INVENTION

Generally speaking, an object of the present invention is to provide an improved fluorescent reflector lamp assembly that can be conveniently mounted in conventional sockets in recessed lighting applications in substitution for incandescent bulbs while providing substantial service life.

More particularly, an object of the present invention is to provide an improved fluorescent reflector lamp assembly that provides long service life in recessed lighting applications while using standard compact fluorescent illuminator tubes such as double twin tubes.

In accordance with the preceding, the present invention generally provides a fluorescent reflector lamp assembly comprising a screw-type base connector, a ballast housing formed of a heat-insulating material connected to the base connector to define a generally annular enclosure that extends outboard about the base connector; a generally annular ballast core mounted within the ballast housing; a reflector shell formed of substantially heat-conductive material and having a tubular base adapted to seat within a recess inboard of the ballast housing; and connecting means mounted in the recess to receive the base of a fluorescent lamp in heat-conducting contact with the reflector.

The foregoing and other aspects of the present invention can be readily ascertained by reference to the following description and attached drawings which illustrate the preferred embodiment.

DETAILED DESCRIPTION OF THE PREFERRED EMBODIMENT

Figure 1:
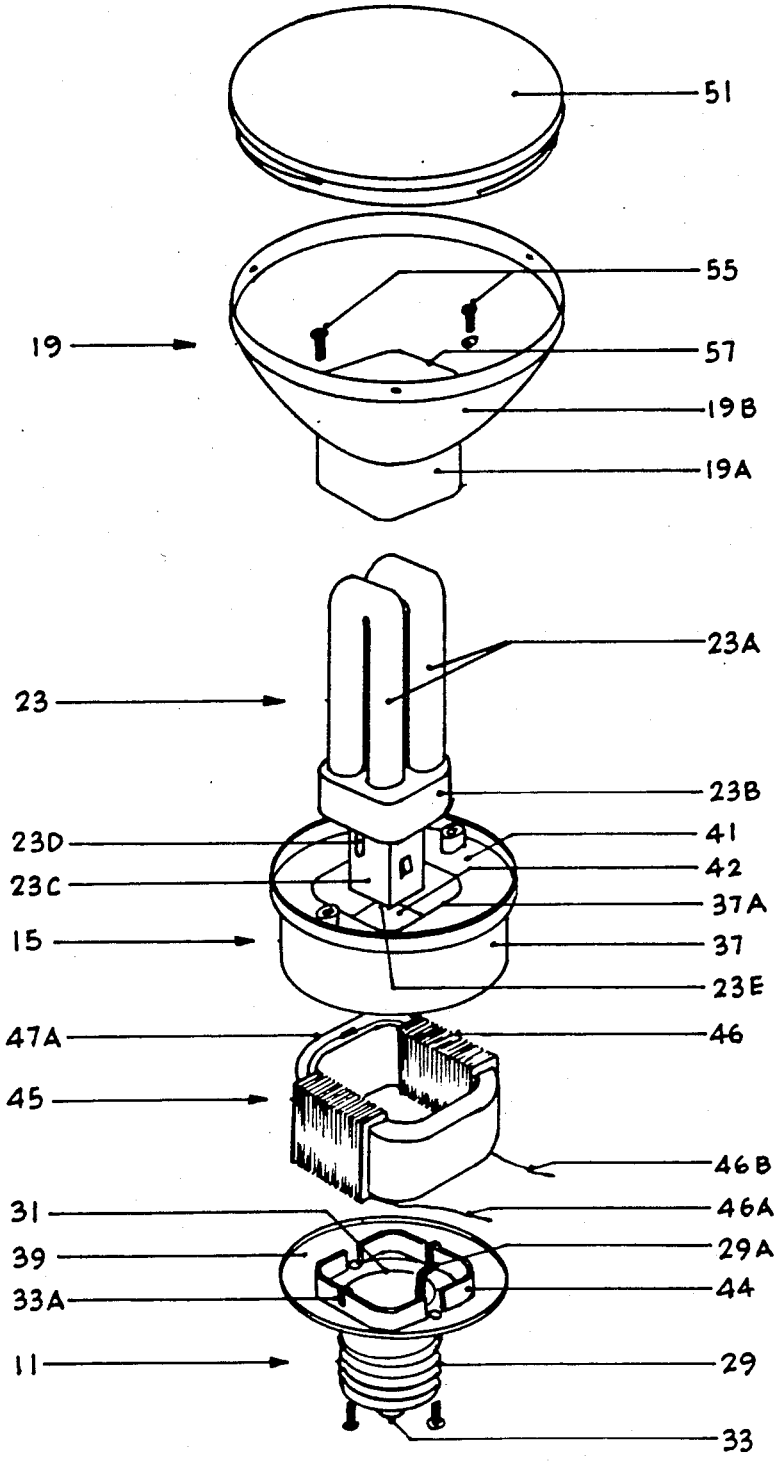
FIG. 1 is a pictorial view of a fluorescent reflector lamp assembly according to the present invention in exploded condition.
Figure 2:
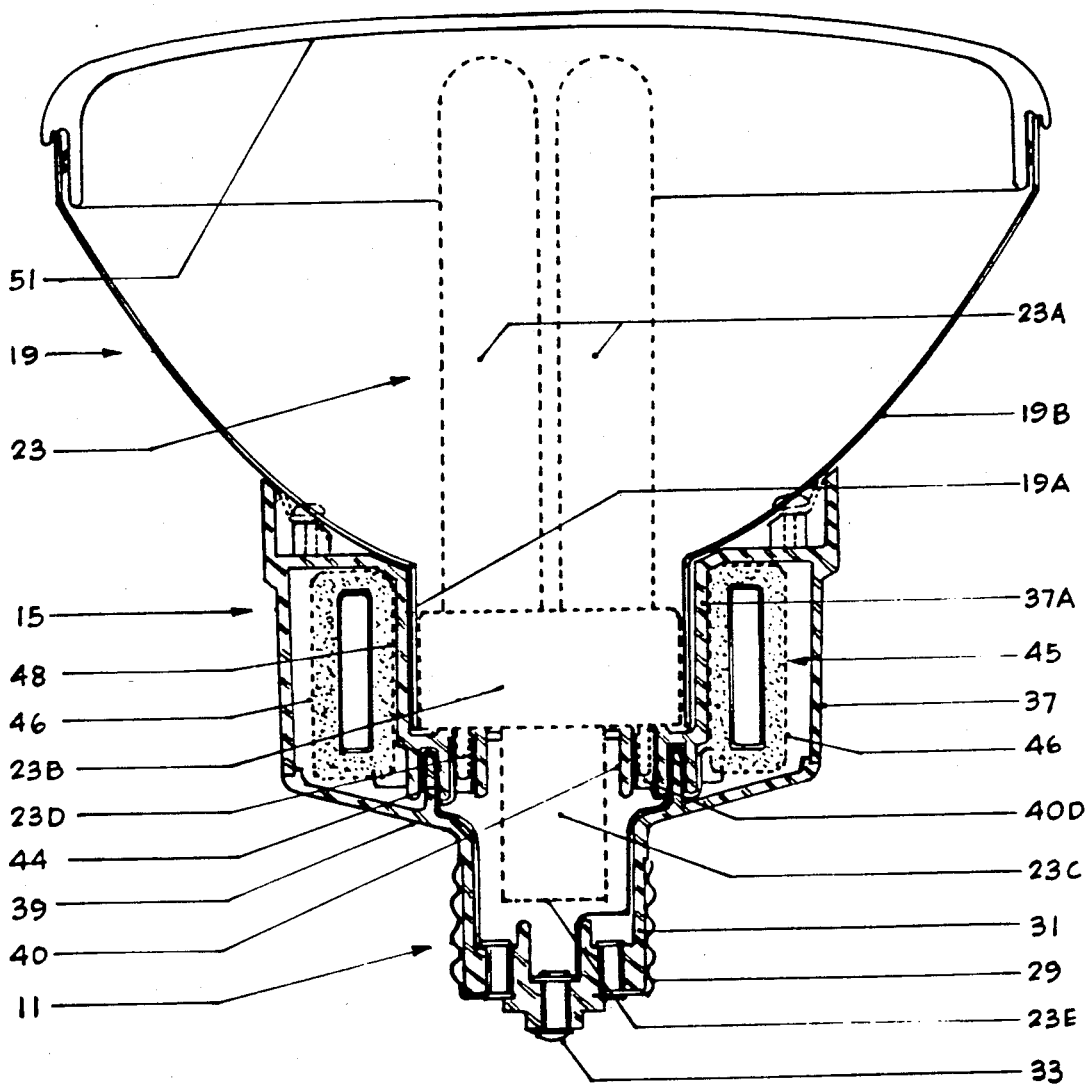
FIG. 2 is a longitudinal cross-sectional view of the fluorescent reflector lamp assembly of FIG. 1 in assembled condition.

As shown in FIGS. 1 and 2, a fluorescent reflector lamp assembly is generally indicated by the numeral 9 and generally includes a screw-type base connector 11, a generally annular ballast housing 15 mounted outboard of base connector 11, a heat conductive reflector member 19 having a base 19A that seats within a recessed area encompassed by ballast housing 15, and a fluorescent illuminator tube assembly 23 that mounts within the recessed area while engaging base 19A of reflector member 19. In the following, each of the components of fluorescent reflector lamp assembly 9 will be described in detail.

Base connector 11 is a conventional component, often referred to as a screw-type or "Edison" base, adapted to screw into so-called "medium base receptacle" sockets for incandescent bulbs. As such, base connector 11 includes a metallic threaded member 29 that is adapted to engage the interior sidewall of a conventional socket to provide mechanical and electrical connection. Further, base connector 11 includes a cylindrical core member 31 formed of an electrically insulating material to support threaded member 29. Also base connector 11 includes a metallic contact member 33 mounted to the lower end of core member 31 for electrically engaging the base of a socket for an incandescent bulb. Contact member is electrically isolated from threaded member 29 by the insulating core member 31. Thus, threaded member 29 and contact member 33 each provide separate conduction paths for carrying electrical current to illuminator tube assembly 23. In FIG. 1, electrical leads that comprise those conduction paths are designated 29A and 33A respectively.

Ballast housing 15 includes a generally cylindrical sidewall 37 mounted in upright condition to a generally frusto-conical member 39 whose smaller end engages the outer periphery of cylindrical core member 31. Further, ballast housing 15 includes a receiver member 41 whose outer periphery engages cylindrical sidewall 37. In the preferred embodiment, receiver member 41 includes an interior wall 37A (FIG. 2) that defines a generally rectangular central recess 42 (FIG. 1) to receive the base and stem of a standard conventional fluorescent lamp, referred to herein as fluorescent illuminator tube assembly 23, of the so-called double twin tube type. As so constructed, ballast housing 15 can be assembled, as shown in FIG. 2, to provide a generally annular enclosure that extends generally symmetrically about the axial centerline of fixture 9.

In the preferred embodiment, ballast housing 15 is formed of a generally heat insulating material, such as plastic or thermoplastic, that is electrically non-conductive. In the illustrated embodiment, it may be noted that ballast housing 15 also includes an interior wall 44 that abuts interior wall 37A to complete the enclosure of the ballast housing 15.

Mounted within ballast housing 15 is a reactance ballast 45. As best shown in FIG. 1, reactance ballast 45 comprises a pair of generally U-shaped core members 47A and 47B mounted so that the ends of their legs are secured together opposite one another. Conducting wire 46 is wound about the opposing legs of core members 47A and 47B in series in a configuration as is customary in autotransformers. That is, a winding 46A comprising a first plurality of turns of wire 46 is formed about one of the junctures of the legs of U-shaped core members 47A and 47B, and a winding 46B comprising a second plurability of turns of wire 46 is formed about the other of the junctures of the legs of U-shaped core members; thus, there may be said to be a pair of windings formed about the U-shaped core members with the laminations of the core members exposed between the windings. One end 46A of coil wire 46 extends for connection to conductor 29A and the other end 46B extends for connection to fluorescent illumination tubes 23. Preferably, U-shaped core members 47A and 47B are formed of laminated material, usually iron, to reduce eddy-current effects while providing suitable reactance. In the preferred embodiment, as best shown in FIG. 2, a gap space 48 is provided between the reactance ballast 45 and the interior sidewall of ballast housing 15.

Reflector member 19 has a generally tubular base 19 and a shell 19B that is generally concave as viewed from the central axis of lamp assembly 9. Preferably, reflector shell 19B has substantially parabolic curvature to reflect light originating from the lamps as a generally collimated beam directed to the area being lighted. Reflector shell 19B and base 19A are integral and are formed of a substantially heat-conducting material such as aluminum or other suitable metal. In practice, the interior surface of reflector shell 19B is formed of, or coated with, highly reflective (i.e., specular) material. Further in practice, a transparent protective cap or lens 51 is sealingly mounted across the enlarged open end, or mouth, of reflector shell 19B.

For reasons that will be explained in detail in the following, reflector base 19A is dimensioned to seat within central recess 40 in receiver member 41 and to surround the base 23B of fluorescent illuminator tube assembly 23 in heat conducting contact therewith. In the illustrated embodiment, reflector member 19 is secured to ballast housing 37 by screws 55 that extend through apertures 57 formed in the sidewall of reflector shell 19B. It should be appreciated, however, that other means can be utilized to secure the reflector 19 to the other portions of lamp assembly 9. It should also be noted that an annular air gap 49 separates tabular base 19A from the surrounding sidewall 37A of ballast housing 15.

Fluorescent illuminator tube assembly 23 preferably is a lamp of the type known as a double twin tube. As such, the lamp includes two U-shaped tubular illuminating tubes 23A, base portion 23B, a stem portion 23C, and a pair of electrical connector prongs 23D. It should be understood that a starter and RF condenser (not shown) are located in base portion 23B. Such lamps are sold under part number F9DTT/27K 02 by the Sylvania Company of Danvers, Mass. as well as other companies.

In assembled condition of lamp 9, as can best be seen in FIG. 2, illuminator tube assembly 23 is mounted in recess 40 in receiver member 41 such that electrical connector prongs 23D extend into sockets 40D formed in receiver member 40 and such that lamp base 23B abuttingly engages a substantial area of the interior sidewall of reflector base 19A. Thus, reflector base 19A is sandwiched between the lamp base 23B and the surrounding adjacent sidewall 40 of ballast housing 15. It should also be noted that, in assembled condition of fluorescent reflector lamp assembly 9, stem 23C of fluorescent illuminator tube assembly 23 extends substantially inward of, and is encompassed by, base connector 11; as a result, stem 23C is substantially thermally isolated from reactance ballast 45.

OPERATION

Operation of fluorescent reflector lamp assembly 9 of FIGS. 1 and 2 will now be described. Initially, it should be assumed that screw-type base connector 11 has been mounted in a standard socket for an incandescent bulb and that a source of electrical power is available at the socket. In such circumstances, source electrical current (ac) can flow through threaded member 29 and conductor 29A to coil 46 of reactance ballast 45. Likewise, electrical current can flow through contact member 33 and conductor 33A. With the source current and voltage appropriately modified by reactance ballast 45, the electrical current flows through connector prongs 23D of fluorescent illuminator tube assembly 23 to energize and illuminate lamp assembly 9.

Upon illumination, a minor fraction of the heat generated by fluorescent illuminator tube assembly 23 is radiant upon the specular surface of reflector shell 19B and is reflected through lens 51. The majority of the heat generated by fluorescent illuminator tube assembly 23, however, is conducted to lamp base 23B. From lamp base 23B, the heat is conducted to the surrounding base 19A of reflector member 19, and then such heat is conducted to reflector shell 19B and dissipated into the surrounding air.

At this juncture, it can be appreciated that fluorescent reflector lamp assembly 9 effectively minimizes the amount of heat from illuminator tube assembly 23 that reaches the interior of ballast housing 15. In part, such thermal isolation of ballast housing 15 is due to the fact that it is mounted radially outboard of illuminator tubes assembly 23. Further, thermal isolation of ballast housing 15 is achieved by the mechanical intervention, or heat barrier shielding, provided by reflector base 19A; in effect, reflector base 19A conducts heat to reflector shell 19B where it is dissipated from lamp assembly 9 prior to reaching ballast housing 15. Still further, heat transfer to and from reactance ballast 45 is minimized by the insulating material that forms housing 15 and by annular spacing gap 48 that separates reactance ballast 45 from the interior sidewall of the housing. The design of ballast member 45 also contributes to heat dissipation because of the extended large surface area of the U-shaped laminated core members 47A and 47B. Also, the design of ballast housing 15 is such that the stem 23C of fluorescent tube assembly 23 extends substantially inward of base connector 11 and is thermally isolated from reactance ballast.

It can thus be understood that fluorescent reflector lamp assembly 9 permits satisfactory use in recessed lighting applications of high-illumination fluorescent lamps having compact profiles (i.e., profiles approximating those of standard R-30 and R-40 incandescent bulbs). More particularly, fluorescent reflector lamp assembly 9 operates to dissipate heat effectively enough to substantially reduce the risk of premature thermal deterioration of its ballast core and starter components. In tests conducted according to standards prescribed by Underwriters Laboratories (U.L.) for recessed lighting fixtures, the temperatures at the bottom 23E of stem 23C of illuminator tubes 23 were found to be about 165 ° F. when ambient temperatures were maintained at about 77 ° F. Such temperatures are well within ranges recommended by U.L. and fluorescent lamp manufacturers and, consequently, cause minimal deterioration of the ballast, starter, and other components of the fluorescent reflector lamp assembly.

Although the present invention has been described with particular reference to the preferred embodiment, such disclosure should not be interpreted as limiting. For example, ballast core 45 can have various other configurations and constructions than the one illustrated; see, for example, the disclosures of U.S. Pat. Nos. 2,665,623; 2,807,710; 2,975,386; 4,129,899; 4,211,957; and 4,443,778. Various other alterations and modifications, in addition to those mentioned above, will no doubt become apparent to those skilled in the art after having read the preceding disclosure. Thus, it should be apparent to those of skill in the art that numerous changes may be made without departing from the spirit and scope of the invention as defined by the claims which follow.

What is claimed is:

1. A fluorescent reflector lamp assembly employing at least one fluorescent illuminator tube assembly and a reflector comprising:

a screw-type base connector adapted to engage screw-type sockets for incandescent bulbs;

a ballast housing formed of a heat insulating material and connected to the base connector to define a central recess and an annular, hollow enclosure that surrounds the central recess;

a ballast core and a coil means formed thereabout for mounting within the annular enclosure;

a reflector member having a generally tubular base for mounting within the central recess defined by the ballast housing, the reflector member further having an integral reflector shell, said shell and base being formed of substantially heat conductive material with the interior surface of the shell being a reflective material for reflecting heat and light;

means mounted in said recess to receive the base of the reflector member and a fluorescent illuminator tube assembly in heat-transfer engagement with a substantial area of the wall of said reflector member base whereby heat is conductively dissipated from the ballast core and illuminator tube assembly while light and heat are reflected from the reflective interior surface of the reflector member; and connecting means to electrically connect the coil means to provide electrical energy for illumination of the fluorescent illuminator tube assembly.

2. A fluorescent reflector lamp assembly according to claim 1 wherein the reflector shell has a outwardly flaring, generally parabolic shape.

3. A fluorescent reflector lamp assembly according to claim 1 wherein the ballast core is mounted to surround the base of the reflector member.

4. A fluorescent reflector lamp assembly according to claim 3 wherein the tubular base of the reflector member is generally rectangular in cross-section.

5. A fluorescent reflector lamp assembly according to claim 4 wherein the central recess defined by the ballast housing is generally rectangular.

6. A fluorescent reflector lamp assembly according the claim 5 wherein said central recess is adapted to receive fluorescent illuminator tube assemblies of the double twin tube type.

7. A fluorescent reflector lamp assembly according to claim 1 wherein the ballast core is formed of two generally U-shaped members mounted with the ends of their legs opposite one another.

8. A fluorescent reflector lamp assembly according to claim 7 wherein the coil means is wound about the ballast core members.

9. A fluorescent reflector lamp assembly according to claim 8 wherein the U-shaped ballast core members are laminated.

10. A fluorescent reflector lamp assembly for use in screw-type sockets comprising:

a generally cylindrical base connector adapted to engage screw-type sockets for incandescent bulbs;

a ballast housing formed of a heat insulating material connected to the base connector to define an annular enclosure for containing a reactance ballast;

a reflector member formed of substantially heat-conductive material and including a reflective shell having a surface formed of a reflective material to reflect heat and light and a generally tubular base adapted to seat within a central recess bounded by the annular ballast housing; and means mounted within said central recess to receive the tubular base of the reflector member and a fluorescent illuminator tube assembly in heat-conducting contact with a substantial area of the sidewall of the base of the reflector member whereby heat is conductively dissipated from the ballast and illuminator tube assembly while light and heat are reflected from the reflective surface of the reflector member.

11. A fluorescent reflector lamp assembly according to claim 10 wherein the reflector shell has a generally parabolic shape.

12. A fluorescent reflector lamp assembly according to claim 10 including a reactance ballast mounted within the ballast housing to surround the base portion of the reflector member.

13. A fluorescent reflector lamp assembly according to claim 12 wherein said ballast core is formed of two generally U-shaped members mounted with the ends of their legs opposite one another.

14. A fluorescent reflector lamp assembly according to claim 13 further including coil means wound around the ballast core.

15. A fluorescent reflector lamp assembly according to claim 12 wherein the connecting means permits the stem of a fluorescent illuminator tube assembly to extend substantially into the base connector beyond the area encompassed by the ballast housing.

16. A fluorescent reflector lamp assembly according to claim 15 wherein the ballast housing includes walls that sealingly enclose the reactance ballast and substantially isolate said stem from said reactance ballast.

17. A fluorescent reflector lamp assembly for use in screw-type sockets in recessed lighting applications comprising:

a generally cylindrical base connector adapted to engage screw-type sockets for incadescent bulbs;

a ballast housing formed of a heat insulating material connected to the base connector to define an annular housing for containing a reactance ballast;

a reflector member formed of substantially heat-conductive material and having a shell having a surface formed of reflective material to reflect heat and light, and a generally tubular base adapted to seat within the central recess bounded by the annular ballast housing; and means mounted within said central recess to receive the base of the reflector member and a fluorescent illuminator tube assembly in heat-conducting contact with a substantial area of the tubular base of the reflector member while permitting the stem of a fluorescent illuminator tube assembly to extend substantially beyond the area enclosed by the annular ballast housing, whereby heat is conductively dissipated from a reactance ballast and illuminator tube assembly while light and heat are reflected from the reflective surface of the reflector member.

18. A fluorescent reflector lamp assembly according to claim 17 wherein said central recess is adapted to receive fluorescent illuminator tube assemblies of the double twin tube type.

19. A fluorescent reflector lamp assembly according to claim 18 wherein the tubular base of the reflector member is generally rectangular in cross-section.

20. A fluorescent reflector lamp assembly according to claim 17 wherein an annular air gap separates the tubular base of the reflector member from the surrounding sidewall of the ballast housing.

21. A fluorescent reflector lamp assembly for use in screw-type sockets in recessed lighting applications comprising:

a generally cylindrical base connector adapted to engage screw-type sockets for incandescent bulbs;

a ballast housing formed of a heat insulating material connected to the base connector to define an annular enclosure for containing a reactance ballast, said annular housing defining a central recess that is generally rectangular in cross-section;

a reflector member formed of substantially heat-conductive material and having a reflective shell with a surface formed of a reflective material to reflect heat and light and a generally tubular base adapted to seat within the central recess bounded by the annular ballast housing;

a ballast transformer mounted within the annular enclosure, said transformer including a ballast core formed of two generally U-shaped laminated members mounted with the ends of their legs opposite one another and a pair of windings wound about the opposing legs of the U-shaped laminated members; and means mounted within said central recess to receive the base of the reflector member and a fluorescent illuminator tube assembly which is in heat-conducting contact with a substantial area of the reflector base whereby heat is conductively dissipated from the ballast transformer and illuminator tube assembly while light and heat are reflected from the reflective interior surface of the reflector member.

22. A fluorescent reflector lamp assembly according to claim 21 wherein said central recess is adapted to receive fluorescent illuminator tube assemblies of the double twin tube type.

23. A fluorescent reflector lamp assembly according to claim 19 wherein the tubular base of the reflector member is generally rectangular in cross-section.

24. A fluorescent reflector lamp assembly for use in screw-type sockets in recessed lighting applications comprising:

a generally cylindrical base connector adapted to engage screw-type sockets for incandescent bulbs;

a ballast housing formed of a heat insulating material connected to the base connector to define an annular enclosure for containing a reactance ballast, said annular housing defining a central recess that is generally rectangular in cross-section;

a reflector member formed of substantially heat-conductive material and having a reflective shell having a surface formed of a reflective material to reflect heat and light and a generally tubular base adapted to seat within the central recess bounded by the annular ballast housing;

a ballast transformer mounted within the annular enclosure, said transformer including a ballast core formed of two generally U-shaped laminated members mounted with the ends of their legs opposite one another and a pair of coil means wound about the opposing legs of the U-shaped members; and means mounted within said central recess to receive the base of the reflector member and a fluorescent illuminator tube assembly which is in heat-conducting contact with a substantial area of the reflector base and which permits the stem of a fluorescent illuminator tube assembly to extend substantially beyond the area enclosed by the annular ballast housing whereby heat is conductively dissipated from the ballast transformer and illuminator tube assembly while light and heat are reflected from the reflective interior surface of the reflector member.

25. A fluorescent reflector lamp assembly according to claim 24 wherein an air gap separates the tubular base of the reflector member from the surrounding sidewall of the reflector member.

* * * * *